US006273199B1

(12) United States Patent
Kiikka et al.

(10) Patent No.: US 6,273,199 B1
(45) Date of Patent: Aug. 14, 2001

(54) ARRANGEMENT IN ROCK DRILL AND METHOD OF CONTROLLING ROCK DRILLING

(75) Inventors: Timo Kiikka, deceased, late of Tampere, by Sirkku Kiikka, Peeta Paullina Kiikka, Josefllna Maarla Kiikka, executors; Timo Muuttonen, Siuro; Pekka Salmlnen, Tampere, all of (FI)

(73) Assignee: Sandvik Tamrock Oy (FI)

( * ) Notice: Subject to any disclaimer, the term of this patent is extended or adjusted under 35 U.S.C. 154(b) by 0 days.

(21) Appl. No.: 09/381,502

(22) PCT Filed: Mar. 19, 1998

(86) PCT No.: PCT/FI98/00242

§ 371 Date: May 19, 2000

§ 102(e) Date: May 19, 2000

(87) PCT Pub. No.: WO98/42481

PCT Pub. Date: Oct. 1, 1998

(30) Foreign Application Priority Data

Mar. 21, 1997 (FI) ..... 971211

(51) Int. Cl.[7] ..... B25D 9/00; E21D 4/06

(52) U.S. Cl. ..... 173/1; 173/105; 173/206; 173/212

(58) Field of Search ..... 173/206, 210, 173/212, 114, 115, 105, 112, 128, 1, 2, 10; 175/27, 296; 92/85 B

(56) References Cited

U.S. PATENT DOCUMENTS 4,109,734 8/1978 Montabert .
4,366,868 * 1/1983 Salmi ..... 173/105
4,567,768 * 2/1986 Matsumoto ..... 173/105
4,582,145 4/1986 Salmi et al. .
4,593,768 * 6/1986 Eklof ..... 173/105
4,624,325 * 11/1986 Steiner ..... 173/212
4,699,223 * 10/1987 Noren ..... 173/10
4,718,500 1/1988 Mori .
4,854,394 * 8/1989 Heinonen ..... 173/105
4,934,465 * 6/1990 Salmi et al. ..... 173/210
5,002,136 3/1991 Barthomeuf .
5,129,464 * 7/1992 Richier ..... 173/1
5,351,763 * 10/1994 Muuttonen ..... 173/210
5,479,996 * 1/1996 Jonsson et al. ..... 173/212
5,520,254 * 5/1996 Weber ..... 173/212

FOREIGN PATENT DOCUMENTS

WO 91/00952 * 1/1991 (SU) ..... 173/2
WO 91/12934 9/1991 (WO) .

* cited by examiner

*Primary Examiner*—Scott A. Smith
(74) *Attorney, Agent, or Firm*—Nixon & Vanderhye P.C.

(57) ABSTRACT

An arrangement in a rock drill comprising a shank and a percussion piston and lifting sleeve for moving the shank towards percussion piston, and a method of controlling rock drilling. The arrangement comprises a lifting sleeve around the shank and a plurality of cylindrical lifting pistons around the shank. In the method, upon downward drilling, the magnitude of the feed force of the rock drill is decreased as the number of extension rods increases, and a force is set to act on some lifting pistons to move the shank towards the percussion point.

11 Claims, 4 Drawing Sheets

ARRANGEMENT IN ROCK DRILL AND METHOD OF CONTROLLING ROCK DRILLING

BACKGROUND OF THE INVENTION

The invention relates to an arrangement in a rock drill comprising at its front end a reciprocating shank to be impacted by a percussion piston reciprocating in the travel direction of the shank, and lifting means, driven by pressurized fluid, for moving the shank toward the percussion piston.

The invention further relates to a method of controlling rock drilling upon drilling a downward extending hole by extension rod drilling by a rock drill comprising at its front end a reciprocating shank to which an extension rod is secured and which is impacted by a percussion piston reciprocating in the travel direction of the shank, a lifting sleeve surrounding the shank and comprising on the side of the percussion piston a lifting surface acting on the shank, at least two lifting pistons arranged to act on the shank and serving to lift the shank by means of pressurized fluid pressure toward the percussion piston so as to move the shank to a desired percussion point in the longitudinal direction of the rock drill, a feed force pushing the rock drill forward being arranged to act in the rock drill during drilling.

In some cases the problem in rock drills is that it should be possible to lift the shank to the percussion point at the moment when the drill equipment gets jammed. This is typically implemented by arranging what is known as a lifting piston either to the shank or separately around it. The pressurized fluid pressure, set to act on the lifting piston, serves to move the shank toward the percussion piston with respect to the front end of the rock drill. Such solutions are known from e.g. U.S. Pat. Nos. 4,109,734, 4,718,500, and 5,002,136. In these solutions the shank is encased in a separate lifting piston, which is a separate annular piece around the shank. The lifting piston moves in a cylinder chamber arranged to the drill body, and has to be sealed in the chamber on both sides in order for the pressurized fluid fed into the cylinder chamber to push the lifting piston, and consequently, the shank through a support surface in the shank, toward the percussion piston, and consequently, the percussion point. The problem in these solutions is that to seal a piston is cumbersome and similarly the clearances have to be relatively wide in every respect in order for the lifting piston and the shank to be able to settle in a suitable position with respect to each other even when the shank is loaded. This again results in extensive pressurized fluid leakage and, consequently, increases pressurized fluid consumption. Furthermore, to seal this structure reliably is cumbersome, and sealing damages occur easily, causing extra operational and maintenance costs.

U.S. Pat. No. 4,582,145 again discloses a solution in which a separate lifting piston surface, moving in a cylinder in the drill body, is arranged to the shank. In this embodiment the shank can be lifted by feeding pressurized fluid into the cylinder chamber so as to make the pressure act on the piston surface of the shank and thus move the shank towards its percussion point. The lifting piston has to be sealed carefully even in this structure and manufacturing the shank causes extra costs. Similarly, the front end of the shank has to be mounted on bearings and sealed in such a manner that when the shank exerts a forward impact, the pressurized fluid being discharged from the cylinder chamber does not break the seals at the front end. This increases the requirements set on the entire structure, and naturally results in increased manufacturing costs.

Another problem in all these solutions is that the lifting force of the shank can only be adjusted or controlled by adjusting the pressurized fluid pressure, and as a result the force of the lifting piston may cause an unnecessarily high resistance to the impact movement generated by the percussion piston. This again causes waste of capacity and unnecessary heating of the pressurized fluid, resulting in lower total drilling capacity.

It is the object of the present invention to provide an arrangement for implementing the lifting of the shank to impact position simply and easily and for selecting the lifting force, which acts on the shank, suitably according to the circumstances. It is a further object of the invention to provide an arrangement that is easy and simple to manufacture and that operates reliably and safely.

It is still a further object of the present invention to provide a method of controlling rock drilling easily and simply when drilling a downward extending hole particularly by extension rod drilling so as to be able to maintain given drilling adjustment parameters substantially the same irrespective of the number of extension rods or the weight of the drill rod, and with which the drilling capacity can be adjusted in various ways as need be, according to the circumstances.

The arrangement of the invention is characterized in that the lifting means comprise around the shank a lifting sleeve comprising on the side of the percussion piston a lifting surface acting on the shank, around the shank a plurality of cylindrical lifting pistons acting on the lifting sleeve at one end and comprising a cylinder chamber for pressurized fluid at the opposite end.

The method of the invention is further characterized in that upon downward drilling, the magnitude of the feed force is reduced as the number of extension rods increases proportionately to their weight, and that as the feed force reaches a preset threshold value Fmin, such a pressurized fluid pressure is set to act in at least some lifting pistons that will maintain the force acting between the rock drill and the shank and moving the rock drill body towards the shank to a desired percussion point substantially at said value.

It is an essential idea of the arrangement of the invention that the shank is lifted by using a separate lifting sleeve which itself does not operate as a piston but instead only transmits the lifting force to the shank. It is a further essential idea of the invention that for generating the lifting force, at least two cylindrical pistons that are placed around the shank substantially symmetrically and that are disposed each in a dedicated cylinder chamber, possibly suitably sealed. It is characteristic of a preferred embodiment of the invention that it comprises at least two groups of pistons with different travel lengths and by means of which the shank can be lifted, depending on the circumstances, a different length towards the percussion point.

It is an essential idea of the method of the invention that when the feed force acting on the rock drill is being reduced as the weight of the extension rods increases, a sufficient power transmission can be ensured by feeding behind the lifting pistons, when required, a pressure which will maintain the force moving the rock drill and the shank toward each other at the level of a preset force, resulting in the shank being at the desired percussion point while a sufficient impact energy transmission is also achieved from the percussion piston via the shank to the extension rod. This way other drilling parameters can be kept in a desired manner substantially the same irrespective of how many extension rods or what kind of a drill rod is secured to the rock drill.

It is an advantage of the invention that the lifting sleeve does not actually need any seal, making its manufacture and mounting easy. It is a further advantage of the invention that the manufacture of small piston cylinders for the drill body or a piece to be secured to the body, and similarly the manufacture of small cylindrical pistons, is easy and simple compared with known solutions. It is still a further advantage of the invention that to control the lifting is easy and simple to implement for different lifting travel lengths. It is still an advantage of the invention that it is easy to add the structure of the invention to existing machines by minimal change of parts. It is a further advantage of the invention that the clearances of the pistons having small diameters are also small, and consequently leakage is minimal, the pistons not necessarily having to be sealed because the leaked oil can be used for lubrication. Still a further advantage is that since the normal structure of the rock drill does not increase in length since the pistons, the shank bearing and a possible flushing device can be incorporated into the same structure even at substantially the same axial point. A further advantage is that when the pistons comprise a seal, the small clearance of the piston throttles the pressure pulse produced by an impact in the seal minimizing the risk of damage to the seal. It is an advantage of the method of the invention that the drilling is easy to adjust since the values of the adjustment parameters needed for adjusting the actual drilling do not have to be changed as the weight of the drill rod or extension rod changes, but the change in weight can be compensated for by means of the feed force and the pressurized fluid pressure acting behind the lifting pistons. A further advantage is that the magnitude of the percussion force acting via the drill bit on the rock to be drilled can be adjusted by adjusting the value of the pressure behind the lifting pistons in such a manner that the shank remains a distance towards the front end of the rock drill from its optimal percussion point, the percussion piston impacting partly on its damping cushion and part of the percussion force being damped at the same time as only the remaining part is able to move via the shank to the drill rod and thus to the drill bit.

The invention will be described below in greater detail in connection with the accompanying drawings.

DETAILED DESCRIPTION OF THE DRAWINGS

Figure 1:
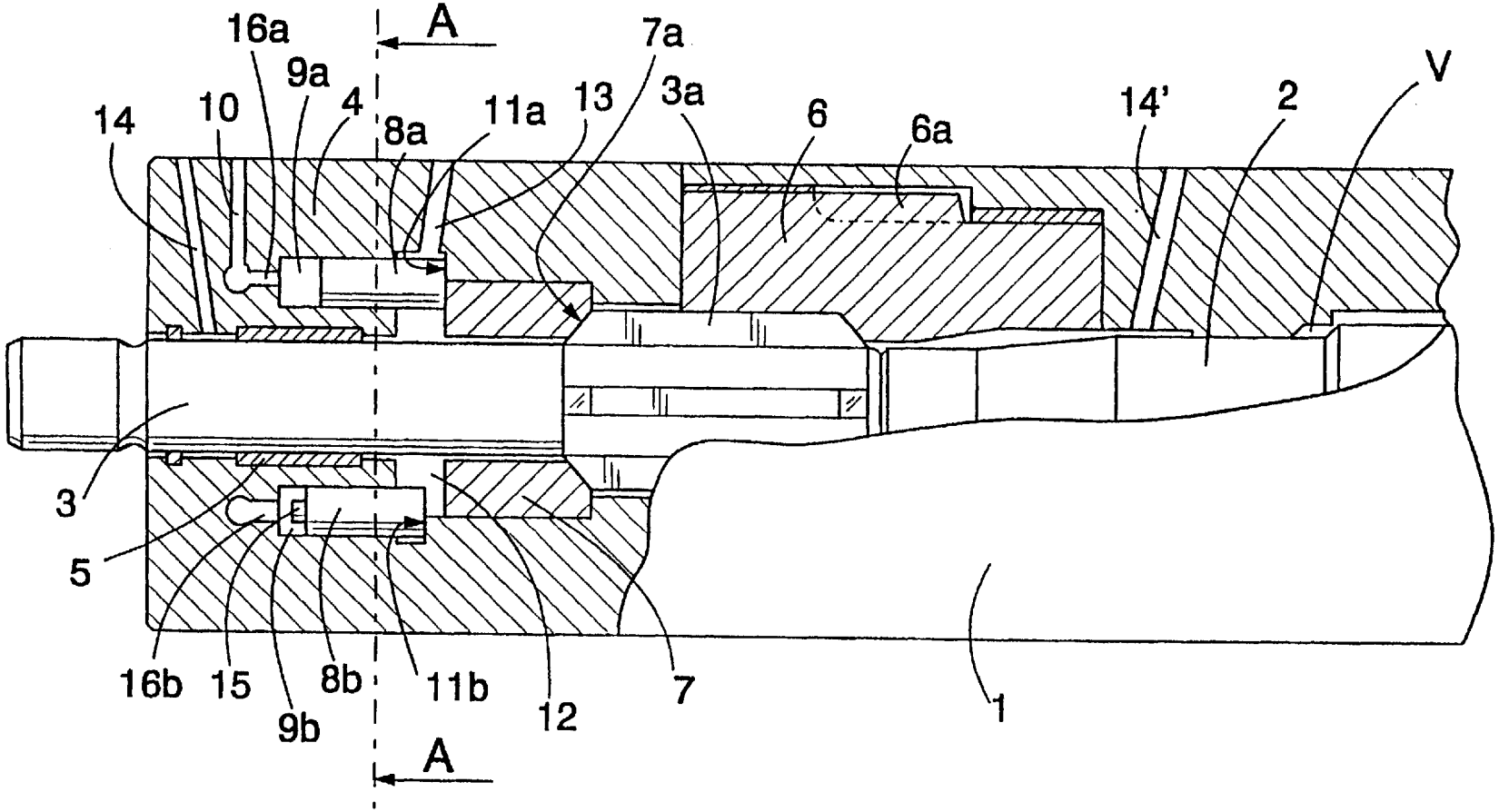
FIG. 1 schematically shows an embodiment of the invention.

FIG. 1 schematically shows a partial section of the front end of a rock drill. A percussion piston 2 is reciprocated within a rock drill body 1 by a striking mechanism, known per se and obvious to those skilled in the art. In front of the percussion piston 2 is arranged a shank 3, to one end of which a drill rod, not shown, is secured in a manner known per se, and whose end facing the percussion piston is normally impacted by the percussion piston during drilling. The body of the rock drill comprises at its front end around the shank 3 a front piece 4 which can be removed from the body 1 to change the shank. The front piece 4 comprises a shank bearing 5 rested on which the shank 3 moves in the axial direction and rotates as a result of rotation. For rotation the shank comprises splines 3*a* via which the shank is rotated by a separate rotating motor in a manner known per se and not shown. In the case shown in the Figure, the shank is surrounded by a rotation sleeve 6, with respect to which the shank can move mainly in its longitudinal direction because of the splines which correspond to its splines. The rotation sleeve 6 in turn is rotated by a rotating motor acting on splines 6*a* on its periphery, the rotation sleeve 6 and the shank 3 rotating together at the same speed.

The front of the splines 3*a* of the shank 3 comprises a lifting sleeve 7 having a lifting surface 7*a* which has a conical surface on the side of the splines 3*a* and is parallel to the surfaces of the ends of the splines 3*a* with bevelled ends. This way the lifting sleeve 7 rests steadily against the ends of the splines 3*a*. Lifting pistons 8*a* and 8*b*, disposed in cylinder chambers 9*a* and 9*b* arranged in the front piece 4, are arranged from the lifting sleeve 7 to the front end of the rock drill, i.e. to the left in the Figure. A common lifting pressure passage 10 leads behind the lifting pistons 8*a* and 8*b*. The pressurized fluid fed into the lifting pressure passage acts behind the pistons 8*a* and 8*b* and moves them towards the rear end of the rock drill, i.e. to the right in the Figure. This way the lifting piston 8*a* and 8*b* serves to push the lifting sleeve 7 and thereby the shank 3 towards the rear part of the rock drill, i.e. towards the percussion piston 2.

As FIG. 1 shows, the percussion pistons 8*a* and 8*b* have different travel lengths, the percussion piston 8*a* being capable of moving in the longitudinal direction of the rock drill a longer way towards the shank 3 before it hits a collar 11*a* that stops the movement. Similarly, the lifting piston 8*b* is able to move a shorter way towards the shank 3 before hitting a collar 11*b*. Owing to this structure, the shank always moves by means of the common force of the pistons 8*a* and 8*b* towards the shank 3, but the shank moves to its actual optimal percussion point solely by the action of the common force of the pistons 8*a*. The shank bearing 5 can be lubricated e.g. in the way shown in the Figure, i.e., there are no separate seals between the lifting pistons 8*a* and 8*b* and the cylinder chambers 9*a* and 9*b*, since the clearance between them is small. Accordingly, the pressurized fluid acting behind the lifting pistons 8*a* and 8*b* is allowed to flow to some degree through the clearance to the side of the lifting sleeve 7 into a space 12 therein. Air is led to the space 12 via an air passage 13, and the air flow, when leaving, takes with it the oil that has entered the space 12 and leads it between the shank 3 and the shank bearing 5. The air and the oil it has conveyed are removed from the front of the bearing 5 at the front end of the rock drill via a discharge passage 14. Furthermore, if the splines of the shank are to be lubricated, this can be carried out by means of a second discharge passage 14', shown in the Figure, whereby the air, as it flows, flows past the splines 3*a* and lubricates them and exits via the passage 14'. The lifting pistons 8*a* and 8*b* can also be made different whereby they have a different damping effect on shank movement. The travel length of the lifting piston 8*a* causes it to receive the impact movement of the shank earlier, damping it if needed. On the other hand, the end of the percussion pistons 8*b* facing the cylinder chamber 9*b* can comprise a throttle peg 15 which at a small clearance can extend into a pressurized fluid passage 16*b* at the rear end of the cylinder chamber 9*b*. In this case, as the throttle peg 15 extends into the passage, the clearance between them acts as a throttle and slows down the discharge of the pressurized fluid from the cylinder chamber 9*b* to the pressurized fluid passage, and consequently acts as an efficient damper as the shank hits up to the front end of its travel length. Similarly, the pressurized fluid passage 16*a* of the lifting piston 8*a* can have a smaller diameter as no throttle peg has to be arranged thereto. The above described throttle peg can of course be similarly arranged to the rear end of the lifting piston 8*a*. The cross section of the throttle peg can also change in such a way that its diameter decreases away from the lifting piston, the throttle effect increasing as the throttle peg 15 penetrates the passage deeper.

Figure 2:
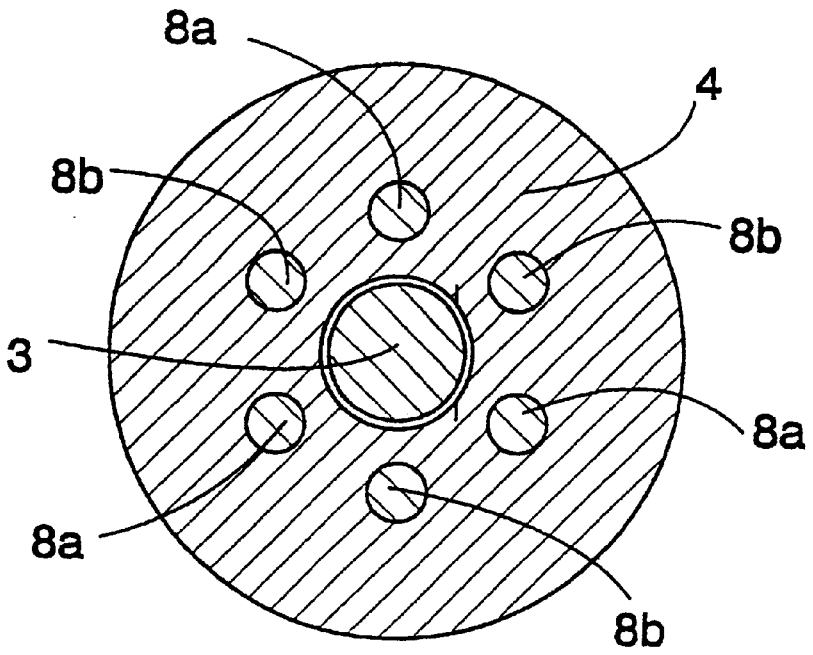
FIG. 2 schematically shows a section of the part marked A—A in FIG. 1.

FIG. 2 schematically shows a section the structure of the embodiment of FIG. 1 at line A—A. This shows how the lifting pistons 8*a* and 8*b* are located around the shank 3 most preferably on the periphery of a circle that is coaxial with the shank in such a way that they alternate with each other, producing the most preferable symmetrical lifting force to the lifting sleeve 7.

Figure 3:
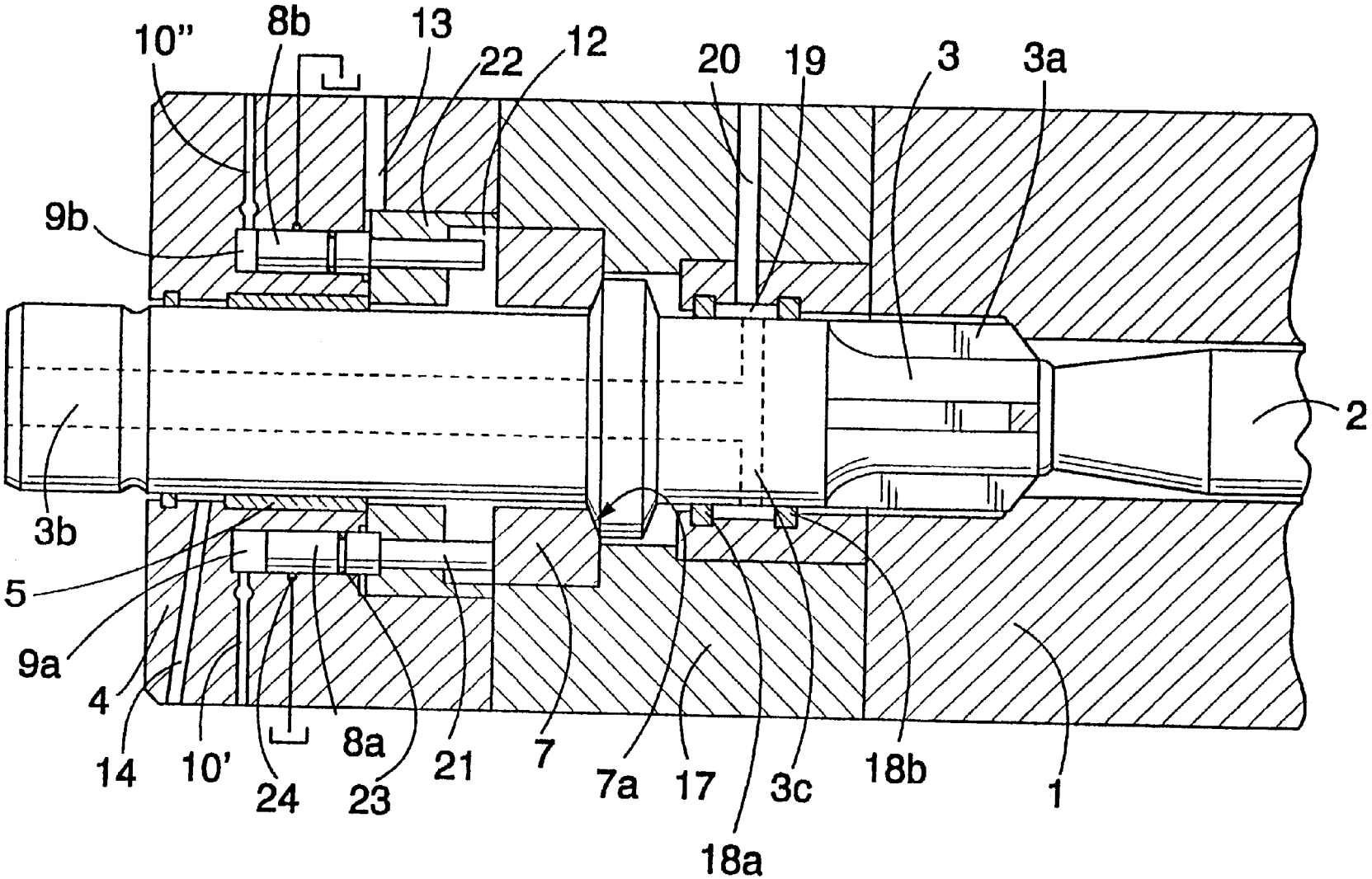
FIG. 3 schematically shows another embodiment of the invention.

FIG. 3 shows similarly a section of the front end of a rock drill, and therein a second embodiment of the invention. In FIG. 3, the same numerals have been used to indicate the corresponding parts in FIGS. 1 and 2 and these parts will not be described separately unless separately required by the understanding of the invention at some point.

The embodiment of FIG. 3 has a rock drill structure comprising at the front end of the rock drill a flushing chamber for feeding flushing agent inside the shank and via it through the drill rod to the drill hole. In this embodiment the body comprises between the front piece 4 and the body 1 a separate spacer 17 into which the flushing chamber structure is arranged. The shank 3 has inside it a flushing passage 3*b* which communicates with the outer surface of the shank 3 by a transverse passage 3*c* arranged through it. On both sides of the transverse passage 3*c* in the longitudinal direction of the shank the shank 3 is surrounded by seals 18*a* and 18*b* for sealing the shank on both sides of the transverse passage 3*c*. Around the transverse passage 3*c* there is a distribution chamber 19 surrounding the shank 3 and forming a space along which the flushing agent is allowed to flow to the transverse passage 3*c* and further forward. The distribution chamber 19 again is connected by a flushing agent passage 20 to the outer surface of the spacer 17 and from there onward in a manner known per se by a hose or the like, not shown, to feeding devices for flushing agent, known per se and not shown.

In this embodiment of the invention the power effect of the lifting pistons 8*a* and 8*b* is led to the lifting sleeve 7 by separate lifting pegs 21. The lifting pegs 21 in turn are arranged to move by means of a separate control sleeve 22, holes corresponding to the lifting pegs 21 being arranged to the control sleeve 22. Similarly, recesses have been arranged to the control sleeve 22 for the lifting pistons 8*a* so that the lifting pistons 8*a* are able to extend deeper than the surface of the control sleeve 22 facing the front end of the rock drill to achieve the desired travel length of a different length. in this embodiment, between the lifting pistons 8*a* and 8*b* and the cylinder chambers 9*a* and 9*b* are also arranged seals 23 for sealing the lifting pistons with respect to the cylinder chambers. To protect the seals 23, discharge grooves 24 into which the pressurized fluid flows from the cylinder chambers 9*a* and 9*b*, are arranged between the lifting pistons 8*a* and 8*b* towards the front end of the rock drill from the seals. The discharge grooves 24 are connected by separate passages to a return hose leading to a pressurized fluid container, so that a substantially zero force is acting on the grooves. Thus the seals 23 will not be subjected to substantially significant pressure impacts, even when the percussion piston 2 strikes the shank 3 to the front end of the shank 3. Lubrication between the shank 3 and its bearing 5 takes place by feeding via the air passage 13 to the front of the lifting pistons 8*a* and 8*b* air containing oil mist, the oil mist flowing from the clearances between the lifting pegs 21 and the control sleeve 22 to the side of the lifting sleeve and from there further between the shank 3 and its bearing 5 and further via the discharge passage 14 to oil separation.

In this embodiment pressures, which can be of mutually different sizes, are arranged to act independently via separate passages 10' and 10" behind the lifting pistons 8*a* and 8*b*, respectively, in such a way that the lifting force generated by the group formed by the lifting pistons 8*a* is different from the common lifting force generated by the lifting pistons 8*a* and 8*b*.

Figure 4:
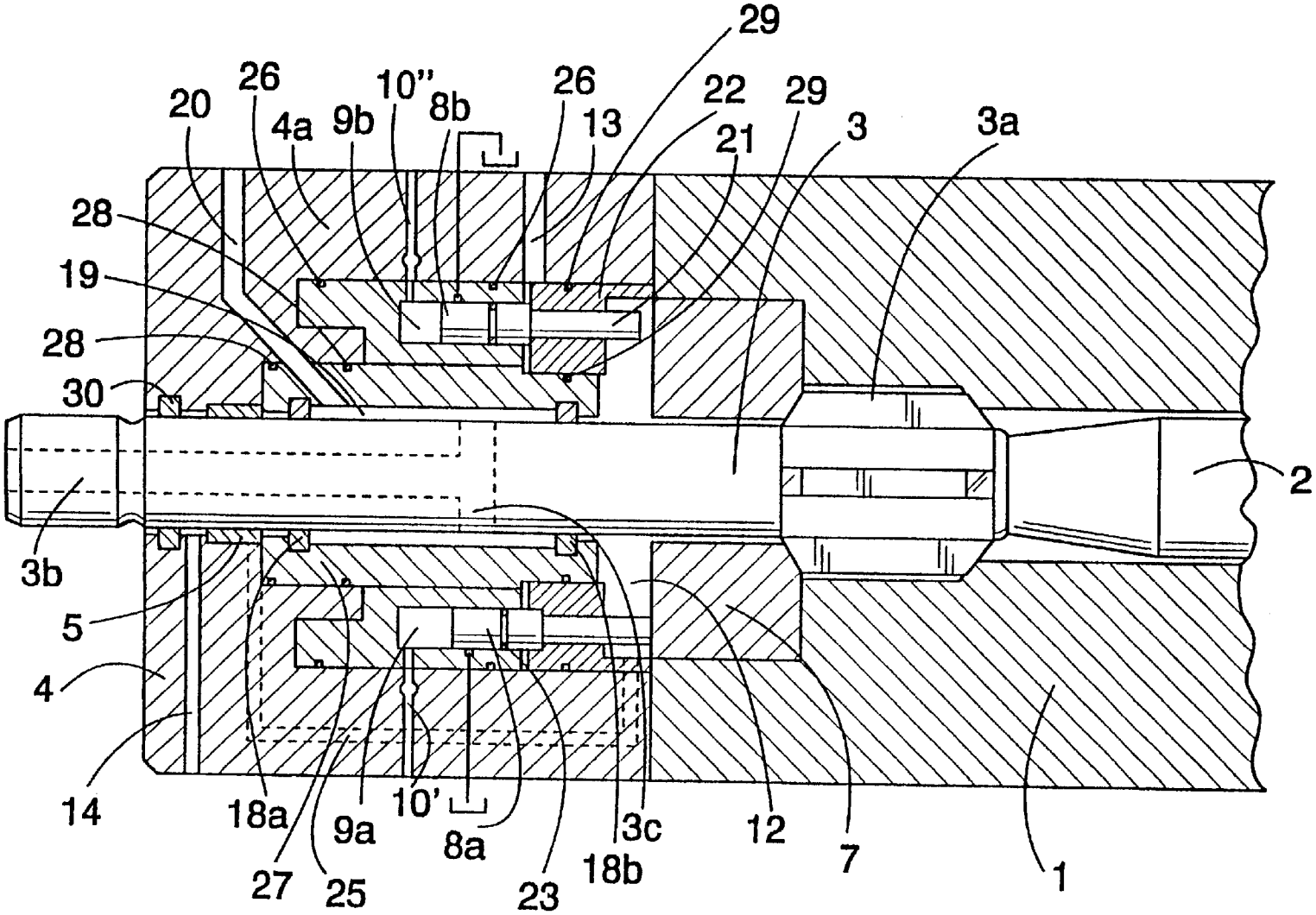
FIG. 4 schematically shows a third embodiment of the invention.

FIG. 4 in turn shows a section of the front end of a rock drill with a third embodiment of the invention. In FIG. 4, the same numerals have been used to indicate the corresponding parts in FIGS. 1 to 3 and these parts will not be described separately unless required by the understanding of the invention. In this embodiment a flushing chamber is arranged to the front piece inside the lifting piston structure. This increases the diameter of the structure, but makes it longitudinally shorter. The operation and structure of the lifting pistons, and the flushing and lubrication operate similarly as in FIG. 3, except that the lubrication of the shank 3 and its bearing 5 is implemented by using a separate lubrication passage 25, which leads air with oil mist from the side of the lifting sleeve past the flushing chamber to its front side through the shank and its bearing 5. FIG. 4 also shows how the different functions can be implemented by using sleeve-like auxiliary components mounted inside the front piece 4, whereby the cylinder chambers 9*a* and 9*b* are arranged to a separate cylinder sleeve 4*a*, sealed where required by seals 26 with respect to the front piece 4. As is shown in FIG. 3, the flushing chamber is similarly formed of a separate flushing sleeve 27, which is similarly sealed with respect to the front piece 4 by seals, where required. In order to provide lubrication, the control sleeve 22, disposed in a groove formed by the front piece 4, the cylinder sleeve 4*a* and the flushing sleeve 27, is sealed at its inner and outer peripheries by a seal 29 to make the oil flow along a given path. The front end of the shank 3 also comprises a seal 30, which is also visible in FIG. 3 and serves to prevent the oil from flowing from between the shank 3 and the front piece 4 out of the rock drill. The Figure and the previous FIG. 3 show how the cylinder chambers 9*a* and 9*b* of the pistons 8*a* and 8*b* can be provided with damping cushions with respect to the passages 10' and 10" towards the front end of the rock drill. In these cases the damping is based on the lifting pistons 8*a* and 8*b*, when entering their cylinder chambers after passing the passages 10' and 10", hitting a liquid cushion which is allowed to be discharged only via the clearances of the pistons 8*a* and 8*b* and the cylinder chambers 9*a* and 9*b* thus causing an intense damping without the pistons impacting mechanically on the bottom of the cylinder.

When drilling with a rock drill according to the invention, the drilling can be adjusted when drilling downward by feeding behind the lifting pistons 8*a* and 8*b* pressurized fluid at such pressure that it generates a force moving the shank and thus the drill rod or extension rod secured thereto towards the percussion piston. This allows the weight increase of the extension rod to be compensated for by increasing the level of the pressure acting behind the lifting pistons 8*a* and 8*b* in a corresponding ratio when adding new extension rods. When the intention is to adjust the percussion force transmitted via the drill bit to the rock to be drilled, the pressurized fluid pressure behind the lifting pistons 8*a* and 8*b* is adjusted in such a way that the shank remains from its optimal percussion point a distance towards the front end of the rock drill, i.e. in this embodiment a distance determined by the percussion pistons 8*b* which have a shorter travel length. This way the percussion piston 2 imparts an impact on a damping cushion located at its front end and marked with the letter V in FIG. 1 and commonly known, resulting in part of the percussion force provided by the percussion piston to disappear to the resistance provided by the damping cushion, and thus only a part of the percussion force exerted by the impact of the percussion piston 2 on the shank is transmitted via the drill rod or the extension rod to the drill bit and thus to the rock to be drilled. Depending on the circumstances, the volume of this extra pressure can be adjusted as desired for transmitting percussion forces of different sizes via the drill bit to the rock.

Figure 5:
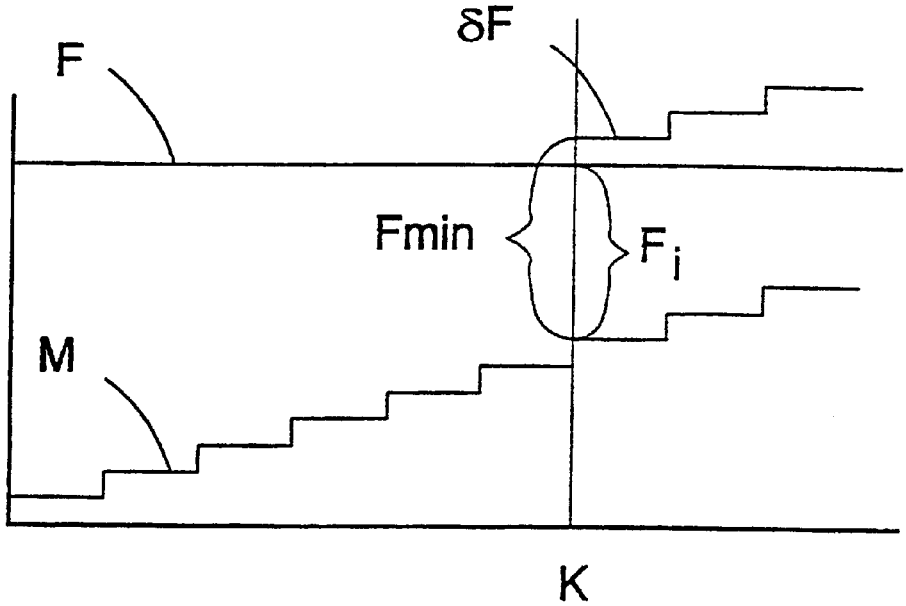
FIG. 5 schematically shows the application of the method of the invention.

FIG. 5 schematically shows how the pressurized fluid pressure acting behind the lifting pistons 8a can be adjusted in downward extension rod drilling in order to achieve the desired rock contact force and power transmission. The Figure shows a stepped line M, representing the force produced by the mass of successively arranged extension rods and which the drill bit uses to depress the rock to be drilled. Line F in turn represents the sum of the weight of the extension rod and the feed force set to act on the rock drill, the feed force being the distance between the stepped line M and line F. In the Figure at point K, when the value of the feed force approaches force Fi, needed to move the body of the rock drill to a new percussion point and also including the force caused by the forward acceleration of the percussion piston, such a pressurized fluid pressure is set to act behind the lifting pistons 8 that will generate a force which moves the shank to its percussion point and is depicted by the stepped curve ΔF above line F. This will cause a force Fmin, which is higher then Fi and which sets the shank and the rock drill to a mutually optimal impact position, to act between the shank and the rock drill. The aim is to keep the difference between the forces Fmin and Fi constant, the shank thus being at the impact moment in a desired manner at a suitable percussion point and the desired energy transmission being implemented. In certain instances, in abnormal circumstances, such as when the drill is jammed, for example, only part of the percussion force might be intended to be used, whereby such a force is naturally set to act on the shank that will make the shank to settle at e.g. a point determined by the pistons 8*b* and only part of the percussion force is allowed to be transmitted.

The above description and drawings illustrate the invention only by way of example and in no way restrict it to these examples. The travel length of the lifting pistons may be equal for all lifting pistons, or the lifting pistons may be of several different travel lengths. Besides between the lifting pistons and the shank or from the lifting pistons towards the rear end of the rock drill, the flushing chamber structure may also be located at the front end of the rock drill in such a way that the lifting pistons are located from the flushing chamber towards the percussion piston. When using different structures, it is naturally evident that suitable seals are used correspondingly in a manner known per se at required points so as to make water, air, oil to pass along the desired passage or path. Other different lubrication arrangements and solutions are also fully possible in a manner known per se.

The arrangement presented in the description and the drawings can also be utilized in a special situation independent of the drilling direction, i.e. in pulling loose by striking a jammed drill rod or drill pipe, in ether words the drilling equipment. In this situation the force required for the extraction is transmitted via the described arrangement to the shank and further to the drill equipment. The striking of the percussion piston to the shank during the extraction contributes to the removal of the equipment. Using full percussion force may, however, damage the equipment, but by using the arrangement for the adjustment of the percussion force in the manner described above, said disadvantage can be avoided.

What is claimed is:

1. An arrangement in a rock drill comprising a reciprocable shank at a front end of the rock drill to be impacted by a percussion piston reciprocable in a direction of travel of the shank; lifting means for moving the shank toward the percussion piston, said lifting means comprising a lifting sleeve surrounding the shank, one end of the lifting sleeve having a lifting surface acting on the shank and a plurality of lifting pistons in respective cylinder chambers arranged around the shank and acting on an opposite end of the lifting sleeve, said plurality of lifting pistons driven by pressurized fluid supplied to said cylinder chamber.

2. An arrangement as claimed in claim 1, wherein said lifting pistons act on said opposite end of said lifting sleeve by means of lifting pegs arranged between said lifting pistons and said opposite end of said lifting sleeve.

3. An arrangement as claimed in claim 1, wherein said lifting pistons have travel lengths that are greater for some of said lifting pistons than others of said lifting pistons in a direction towards the shank so as to allow said some of said lifting pistons to move closer to said percussion piston.

4. An arrangement as claimed in claim 3, wherein said plurality of lifting pistons includes at least two separate groups of lifting pistons, each group driven by separately supplied pressurized fluid pressure.

5. An arrangement as claimed in claim 4, wherein, when said some of said plurality of lifting pistons have extended through respective travel lengths towards the percussion piston, said some of said plurality of pistons are in extreme positions in the direction of the shank, and the shank is in an optimal position for transmission of impact energy.

6. An arrangement as claimed in claim 1, wherein said shank extends through a front piece of said rock drill, and a bearing is mounted in said front piece with said shank extending through said bearing; and further wherein at least some lifting pistons are mounted in respective ones of said cylinder chambers without separate seals, such that pressurized fluid is allowed to flow in clearances between said at least some of said lifting pistons and said respective ones of said cylinder chambers to the surface of the shank in a space adjacent said opposite end of said lifting sleeve; the arrangement further comprising means for supplying air to said space for conveying the pressurized fluid to the bearing for lubrication of the bearing.

7. An arrangement as claimed in claim 1 and further comprising a flushing sleeve forming a flushing chamber for feeding flushing agent via passages arranged in the shank to the hole to be drilled, and wherein the lifting pistons are mounted around the flushing sleeve.

8. An arrangement as claimed in claim 1, wherein the front end of the rock drill comprises a bearing surrounding the shank, and wherein the lifting pistons are mounted in an annular array about the bearing.

9. A method of controlling a rock drill upon drilling a downward extending hole utilizing a number of extension rods and a drill bit, wherein the rock drill comprises at its front end a reciprocable shank to which an extension rod is secured and which is impacted by a percussion piston reciprocable in a travel direction of the shank; a lifting sleeve surrounding the shank, one end of the lifting sleeve having a lifting surface acting on the shank; a plurality of lifting pistons in respective cylinder chambers arranged to act on an opposite end of the lifting sleeve and thereby serving to lift the shank by means of pressurized fluid pressure toward the percussion piston so as to move the shank to a desired percussion point, and wherein a feed force for pushing the rock drill forward is arranged to act on the rock drill during drilling; the method comprising upon downward drilling, reducing the magnitude of the feed force as the number of extension rods increases, proportionately to the weight of said extension rods, and, when the feed force reaches a preset threshold value $F_{min}$, causing the pressurized fluid pressure to act in at least some of the lifting pistons so as to maintain a force acting between the rock drill and the shank, and moving the rock drill body towards the shank to a desired percussion point substantially at said threshold value.

10. The method as claimed in claim 9, wherein the pressurized fluid pressure is always increased when a new extension rod is added, proportionately to the force increase produced by the mass of the new extension rod.

11. The method as claimed in claim 9, wherein the pressurized fluid pressure acting on the lifting pistons is adjusted in such a manner that the shank remains a distance towards the front end of the rock drill from the optimal percussion point of the shank, and wherein part of the impact energy of the percussion piston is damped on a damping cushion located at the front end of the percussion piston, such that only part of the percussion force is transmitted via the shank to the drill bit.

* * * * *